United States Patent [19]

Gemmel et al.

[11] 4,284,439

[45] Aug. 18, 1981

[54] PROCESS FOR THE PRODUCTION OF SHEET AND STRIP FROM FERRITIC, STABILIZED, STAINLESS CHROMIUM-MOLYBDENUM-NICKEL STEELS

[75] Inventors: Göran Gemmel; Christer Åslund, both of Torshälla, Sweden

[73] Assignee: Granges Myby AB, Nybybruk, Sweden

[21] Appl. No.: 114,087

[22] PCT Filed: Aug. 16, 1978

[86] PCT No.: PCT/EP78/00011

§ 371 Date: Apr. 17, 1979

§ 102(e) Date: Apr. 17, 1979

[87] PCT Pub. No.: WO79/00100

PCT Pub. Date: Mar. 8, 1979

[30] Foreign Application Priority Data

Aug. 17, 1977 [DE] Fed. Rep. of Germany ..... 2737116

[51] Int. Cl.[3] ..... C21D 8/02; C22C 38/44

[52] U.S. Cl. ..... 148/12 EA; 75/128 W; 148/37; 148/135

[58] Field of Search ..... 148/12 E, 12 EA, 12.4, 148/37, 135; 75/128 W

[56] References Cited

U.S. PATENT DOCUMENTS

| | | | |
|---|---|---|---|
| 3,337,331 | 8/1967 | Ljungbesg | 148/37 |
| 3,689,325 | 9/1972 | Hayden, Jr. et al. | 148/12 E |
| 3,837,847 | 9/1974 | Bieber | 75/128 W |
| 3,856,515 | 12/1974 | Brandis et al. | 75/128 W |
| 3,865,644 | 2/1975 | Hellner et al. | 75/128 W |
| 3,926,685 | 12/1975 | Gueussier et al. | 148/135 |
| 3,929,520 | 12/1975 | Hellner et al. | 148/37 |
| 4,010,049 | 3/1977 | Rarey | 148/37 |
| 4,055,448 | 10/1977 | Fujikura et al. | 75/128 W |
| 4,119,765 | 10/1978 | Pinnow et al. | 148/37 |
| 4,155,752 | 5/1979 | Oppenheim | 148/37 |

*Primary Examiner*—Peter K. Skiff

*Attorney, Agent, or Firm*—Craig and Antonelli

[57] ABSTRACT

A process for the production of sheet an strip from ferritic, stabilized, stainless chromium-molybdenum-nickel steels by hot-rolling of cast blocks to form heavy plate or crude strip and subsequent cold-rolling to the required thickness, wherein the blocks are hot-rolled at temperatures above about 850° C. to form heavy plate or crude strip and, immediately afterwards, the heavy plate or crude strip thus formed is suddenly (rapidly) quenched with water to a temperature just below 450° C. and subsequently annealed, the annealing step being followed by sudden (rapid) cooling from temperatures above about 850° C. to temperatures below 500° C.

16 Claims, No Drawings

PROCESS FOR THE PRODUCTION OF SHEET AND STRIP FROM FERRITIC, STABILIZED, STAINLESS CHROMIUM-MOLYBDENUM-NICKEL STEELS

DESCRIPTION

In the production of sheet and strip from stainless steels by rolling, the block is heated to the rolling temperature and rolled in several passes, intermediate treatments and, in particular, surface treatments, such as grinding, generally having to be inserted, which can only be done at temperatures of at most 300° C. Surface treatment in slab form is particularly important in this respect.

It has now been found that, despite an extremely good surface quality of the block, ferritic chrome-molybdenum-nickel steel with nickel and molybdenum contents of up to about 5% is particularly unsuitable for intermediate treatments of the type in question because the material is destroyed by sudden hardening phenomena and cracking. This tendency towards hardening and cracking is particularly pronounced in crude plate, i.e. in heavy plate and crude strip having a thickness of from about 3 mm to about 8 mm and, in particular, around 5 mm. It is reflected inter alia in the fact that a strip rolled into a coil cannot be unrolled because it is too hard and, at the same time, contains cracks.

The object of the present invention is to provide a process which obviates these disadvantages and gives satisfactory sheet and strip material with favourable properties.

According to the invention, this object is achieved by a process which is characterised in that the cast blocks are hot-rolled at temperatures above about 850° C. to form heavy plate or crude strip and, immediately afterwards, the crude strip thus obtained is suddenly (rapidly) quenched with water to a temperature just below 450° C. and is subsequently annealed, annealing being followed by sudden (rapid) cooling from temperatures above about 850° C. to temperatures below 500° C., the heavy plate or crude strip having a thickness of from about 3 to 8 mm and, in particular, around 5 mm.

The invention shows how this relatively expensive steel can be processed by rolling and under certain conditions of heat treatment and how it retains its extremely favourable properties in its final strip form.

According to the invention, the intermediate products are not exposed at any stage of the entire rolling process to gradual cooling to temperatures from above about 850° C. to just below 450° C., which applies in particular to the condition after finish-rolling. Since this steel shows particularly good hot forming properties, the material is prevented from falling below the upper temperature limit of 850° C. and from slowly passing through the temperature range from 850° C. to 450° C. by directly rolling down the block in a single operation to form the heavy plate or crude strip, the final temperature having to be above 850° C. from which the heavy plate or crude strip is suddenly (rapidly) cooled to below 450° C. The thickness of the heavy plate or crude strip preferably amounts to between about 3 mm and about 8 mm and advantageously to approximately 5 mm.

The process according to the invention may be applied with advantage to chrome-molybdenum-nickel steels having the following composition:

0.01 to 0.025% of carbon
0.005 to 0.025% and preferably 0.005 to 0.015% of nitrogen
22.0 to 27.0% of chromium
3.0 to 5.0% of molybdenum
3.2 to 4.8% of nickel
0.02 to 1.0% of manganese
0.02 to 1.0% of silicon
at most 0.25% each of vanadium, tungsten, cobalt and aluminium
0.1 to 1.0% of copper
0.2 to 0.7% of titanium and/or
0.2 to 1.0% of niobium, the rest consisting of iron with the usual impurities and alloying additions of boron and/or zirconium being permitted in contents corresponding to the prior art.

The invention will now be explained in more detail with reference to an example. A block weighing 10 t, which had been melted and cast by the AOD method, had the following composition:

0.012% of carbon
0.4% of silicon
0.32% of manganese
25.7% of chromium
4.2% of nickel
4.08% of molybdenum
0.45% of titanium
0.55% of copper
0.059% of aluminium
0.011% of niobium
0.015% of nitrogen
rest iron.

This block was preheated and introduced into a reheating furnace in which it was heated to temperatures of from about 1150° C. to about 1250° C. and, in particular, to a temperature of about 1200° C. The block was then introduced into the hot rolling stand and, in a single operation, was rolled down to a thickness of about 5 mm directly, i.e. without interruption. According to the invention, the strip emerging from the hot rolling stand was suddenly (rapidly) quenched with water from a temperature above about 850° C. to a temperature of 420° C. The strip was then subjected to an annealing treatment which also characterises the invention in that annealing was followed by sudden (rapid) cooling from temperatures above about 850° C. to temperatures below 500° C., preferably around 400° C., after which the strip was pickled and rolled into a coil which was introduced into the cold rolling stand.

In the production of steel of the same quality without the characteristics of the present invention, the block was hot rolled into slab form, i.e. to a thickness of 150 mm, and was then slowly cooled. The slab surface was fault-free in the hot state. When the slab was re-examined after complete cooling, such serious cracking was found that the slab could not be used for further processing.

In another case, steel of the same quality was again melted, but directly rolled down to approximately 5 mm thick strip, followed by slow cooling. While still hot, the strip was rolled into a coil. However, the strip could not be coiled again after cooling because it had become extremely hard and brittle. At the same time, serious cracking was found so that the entire strip had to be discarded as scrap.

Another very important measure in the practical application of the process according to the invention lies in the fact that the intermediate annealing treatment, particularly between the individual cold-rolling passes, should be carried out at a temperature around 1025° C. which preferably should not deviate by more than about ±25° C. in either direction.

In addition, it is also necessary during welding of the sheets and strips thus produced to pass through temperature ranges which, according to the invention, should be avoided. Accordingly, provision should also be made for rapid cooling in cases where low cooling rates between 850° C. and 450° C. can occur. This applies in particular to the welding of relatively thick sheet, but is not necessary in the welding of sheets less than 2 mm thick. However, whether heating is intentional or unintentional, the sheets will always be heated to around 1025° C. and rapidly cooled to a temperature from above about 850° C. to below about 450° C.

We claim:

1. A process for the production of sheet and strip from ferritic, stabilised, stainless chromium-molybdenum-nickel steels which are hot-rolled in the form of cast blocks to form heavy plate or crude strip and subsequently cold-rolled to the required thickness, characterised in that the blocks are hot-rolled at temperatures above about 850° C. to form heavy plate or crude strip and immediately afterwards the heavy plate or crude strip thus formed is suddenly quenched with water to a temperature slightly below 450° C. and is then subsequently annealed to a temperature above 850° C., the annealing step being followed by rapid cooling from temperatures above about 850° C. to temperatures below 500° C.

2. A process as claimed in claim 1, characterised in that the hot-rolled heavy plate or crude strip has a thickness of from about 3 mm to about 8 mm.

3. A process as claimed in claim 2, characterised in that the hot-rolled heavy plate or crude strip has a thickness of about 5 mm.

4. A process as claimed in claim 1 or 2 or 3, characterised in that the hot rolling of the blocks to form heavy plate or crude strips is performed at a starting temperature of from about 1150° C. to about 1250° C. in a single operation without intermediate annealing, and wherein cold rolling is performed as the final step, with intermediate annealing being carried out between individual cold rolling passes at a temperature of from about 1000° to about 1050° C.

5. A process as claimed in claim 4, characterised in that the blocks are hot-rolled at a starting temperature of around 1200° C.

6. A process as claimed in claim 1 or 2 or 3 or 5, characterised in that the starting material used is a chrome-molybdenum-nickel steel which consists of 0.01 to 0.025% of carbon, 0.005 to 0.025% of nitrogen, 0.02 to 1.0% of manganese, 0.02 to 1.0% of silicon, 22.0 to 27.0% of chromium, 3.0 to 5.0% of molybdenum, 3.2 to 4.8% of nickel, 0.1 to 1.0% of copper, 0.2 to 0.7% of titanium and/or 0.2 to 1.0% of niobium and of vanadium, tungsten, cobalt and aluminum in maximum proportions of 0.25% in each case, the rest consisting of iron with the usual impurities, alloying additions of boron and/or zirconium being permitted.

7. A process as claimed in claim 4, characterised in that the starting material used is a chrome-molybdenum-nickel steel which consists of 0.01 to 0.025% of carbon, 0.005 to 0.025% of nitrogen, 0.02 to 1.0% of manganese, 0.02 to 1.0% of silicon, 22.0 to 27.0% of chromium, 3.0 to 5.0% of molybdenum, 3.2 to 4.8% of nickel, 0.1 to 1.0% of copper, 0.2 to 0.7% of titanium and/or 0.2 to 1.0% of niobium and of vanadium, tungsten, cobalt and aluminum in maximum proportions of 0.25% in each case, the rest consisting of iron with the usual impurities, alloying additions of boron and/or zirconium being permitted.

8. A process as claimed in claim 1 or 2 or 3, wherein intermediate products formed during the process are prevented from being exposed to gradual cooling from temperatures above about 850° C. to just below 450° during the entire hot-rolling step.

9. Process for the production of strip from ferritic, stabilised, stainless chromium-molybdenum-nickel steels with nickel and molybdenum contents of up to about 5%, wherein the cast heavy plate is hot-rolled to a thickness of about 5 mm and the crude strip produced in this way is subsequently cold-rolled to the required thickness, the hot-rolled crude strip being rolled into a coil and unrolled again when being cold-rolled, characterised in that the cast heavy plate is hot-rolled, at a temperature of about 1200° C., in one pass to a thickness of about 5 mm and the crude strip produced in this way, after having emerged from a hot rolling stand is immediately rapidly quenched with water from a final temperature above about 850° C. to a temperature slightly below 450° C., is subsequently annealed and then is cold-rolled.

10. Process as claimed in claim 9, characterised in that the strip is pickled and rolled into a coil prior to said cold rolling.

11. Process as claimed in claim 9, characterised in that the ferritic, stabilised, stainless chromium-molybdenum-nickel steels consist of 0.01 to 0.025% of carbon,
0.005 to 0.025% preferably 0.005 to 0.015% of nitrogen,
22.0 to 27.0% of chromium,
3.0 to 5.0% of molybdenum,
3.2 to 4.8% of nickel,
0.02 to 1.0% of manganese,
0.02 to 1.0% of silicon, vanadium, tungsten, cobalt, and aluminum in maximum proportions of 0.25% each, 0.1 to 1.0% of copper,
0.2 to 0.7% of titanium and/or
0.2 to 1.0% of niobium, the rest consisting of iron with the usual impurities, alloying additions of boron and/or zirconium being permitted.

12. Process for the production of sheet from ferritic, stabilised, stainless chromium-molybdenum-nickel steels with nickel and molybdenum contents of up to about 5%, wherein the cast heavy plate is hot-rolled to a thickness of about 5 mm and the crude sheet produced in this way is subsequently cold-rolled to the required thickness, characterised in that the heavy plate is hot-rolled in one pass at a temperature of about 1200° C. to a thickness of about 5 mm and the crude sheet produced in this way is then removed from a hot rolling stand and immediately rapidly quenched with water from a final temperature above about 850° C. to a temperature slightly below 450° C., is thereafter annealed and then cold-rolled.

13. Process as claimed in claim 12, characterised in that the annealing is performed at a temperature of above about 850° C. and directly followed by rapid quenching to a temperature of below 500° C., subsequently pickled and then cold-rolled, intermediate annealing being carried out at about 1000° C. to 1050° C. between the individual cold-rolling passes.

14. Process as claimed in claim 13, wherein the quenching directly following said annealing is to about 400° C.

15. Process as claimed in claim 12 or 13, characterised in that the ferritic, stabilised, stainless chromium-molybdenum-nickel steels consist of:

0.01 to 0.025% of carbon,
0.005 to 0.025% preferably 0.005 to 0.015% of nitrogen,
22.0 to 27.0% of chromium,
3.0 to 5.0% of molybdenum,
3.2 to 4.8% of nickel,
0.02 to 1.0% of manganese,
0.02 to 1.0% of silicon, vanadium, tungsten, cobalt, and aluminum in maximum proportions of 0.25% each, 0.1 to 1.0% of copper,
0.2 to 0.7% of titanium and/or
0.2 to 1.0% of niobium, the rest consisting of iron with the usual impurities, alloying additions of boron and/or zirconium being permitted.

16. Process as in claim 1 or 8 or 12, wherein the quenching immediately following said hot-rolling is to a temperature of about 420° C.

* * * * *